US011221130B1

(12) United States Patent
Tsai

(10) Patent No.: US 11,221,130 B1
(45) Date of Patent: Jan. 11, 2022

(54) LIGHT STRING HAVING TWISTED WIRES

(71) Applicant: Cosmo Lighting Inc., Walnut, CA (US)

(72) Inventor: Nai-Chen Tsai, New Taipei (TW)

(73) Assignee: COSMO LIGHTING INC., Walnut, CA (US)

( * ) Notice: Subject to any disclaimer, the term of this patent is extended or adjusted under 35 U.S.C. 154(b) by 0 days.

(21) Appl. No.: 17/153,971

(22) Filed: Jan. 21, 2021

(51) Int. Cl.
*F21V 23/00* (2015.01)
*F21S 4/10* (2016.01)
*F21Y 115/10* (2016.01)

(52) U.S. Cl.
CPC ..... *F21V 23/001* (2013.01); *F21S 4/10* (2016.01); *F21V 23/003* (2013.01); *F21Y 2115/10* (2016.08)

(58) Field of Classification Search
CPC .... F21V 23/001; F21V 23/003; F21V 21/008; F21S 4/10; F21S 4/00; F21W 2121/04; F21Y 2115/10; D07B 1/0693; H01B 5/08
See application file for complete search history.

(56) References Cited

U.S. PATENT DOCUMENTS

| | | | | |
|---|---|---|---|---|
| 6,042,418 | A * | 3/2000 | Cummings | A47G 33/08 439/505 |
| 6,352,353 | B1 * | 3/2002 | Liu | F21S 4/10 362/227 |
| 7,481,555 | B2 * | 1/2009 | Huang | F21S 4/10 362/249.06 |
| 10,082,258 | B2 * | 9/2018 | He | F21V 23/001 |
| 10,288,236 | B1 * | 5/2019 | Chen | F21V 33/0028 |
| 2021/0071850 | A1 * | 3/2021 | Shan | F21S 4/20 |

* cited by examiner

*Primary Examiner* — Peggy A Neils
(74) *Attorney, Agent, or Firm* — Li & Cai Intellectual Property (USA) Office

(57) ABSTRACT

A light string is provided. The light string at least includes a wire set and a plurality of light-emitting diode chips. A first main wire segment of a first wire and a second main wire segment of a second wire are twisted together to form a main wire set. Non-bonding segments of the first sub-wire segments and the second sub-wire segments are respectively twisted together to respectively form a plurality of sub-wire sets. The sub-wire sets are spaced from each other and extended outward in a direction away from the main wire set. The light-emitting diode chips are respectively bonded to bonding segments of the sub-wire sets and spaced from each other on the sub-wire sets.

19 Claims, 14 Drawing Sheets

LIGHT STRING HAVING TWISTED WIRES

FIELD OF THE DISCLOSURE

The present disclosure relates to a light string, and more particularly to a light string having twisted wires to which a plurality of light-emitting diode chips bonded.

BACKGROUND OF THE DISCLOSURE

In celebration days of Spring Festival, Christmas day and so on, people hang generally various decorative light strings to decorate a room, an aisle, Christmas trees and so on. However, these light strings are consisted of a plurality of light-emitting diodes and wires that are messy and tangled.

SUMMARY OF THE DISCLOSURE

In response to the above-referenced technical inadequacies, the present disclosure provides a light string that includes a wire set, a plurality of light-emitting diode chips and a lighting controller. The wire set includes a main wire set and a plurality of sub-wire sets. A plurality of wires includes a first wire and a second wire. The first wire includes a first main wire segment and a plurality of first sub-wire segments. The second wire includes a second main wire segment and a plurality of second sub-wire segments. The first main wire segment and the second main wire segment are twisted together to form the main wire set. Each of the first sub-wire segments and the second sub-wire segments includes a plurality of non-bonding segment and one or more bonding segments. The non-bonding segments of the first sub-wire segments and the second sub-wire segments are respectively twisted together to respectively form the sub-wire sets. The sub-wire sets are spaced from each other and extended outward in a direction away from the main wire set. A plurality of light-emitting diode chips are respectively bonded to the bonding segments of the sub-wire sets and spaced from each other on the sub-wire sets. A lighting controller is electrically connected to the wires and a power supply source. The lighting controller is configured to receive and transmit power from the power supply source to the light-emitting diode chips, and output a control signal respectively to the light-emitting diode chips through the wires to control the light-emitting diode chips to emit light.

In certain embodiments, a positive terminal of each of the light-emitting diode chips is electrically bonded to one of the first sub-wire segments, and a negative terminal of each of the light-emitting diode chips is electrically bonded to one of the second sub-wire segments.

In certain embodiments, the light string further includes a plurality of covering elements by which the plurality of light-emitting diode chips are respectively covered. Each of the covering elements is made of a transparent material or a translucent material that is transparent to the light emitted by one of the light-emitting diode chips.

In certain embodiments, the covering elements are atomized, or made of a transparent material, a non-transparent material or a translucent material.

In certain embodiments, the light string further includes a plurality of bulb shells inside which the covering elements are respectively housed.

In certain embodiments, the sub-wire sets are classified into a plurality of groups that are spaced from each other, the sub-wire sets in different ones of the groups are respectively extended from a plurality of positions on the main wire set, and the sub-wire sets in the same one of the groups are extended from the same position on the main wire set.

In certain embodiments, the plurality of wires further includes one or more third wires that are twisted with the first main wire segment of the first wire and the second main wire segment of the second wire to form the main wire set.

In certain embodiments, the sub-wires are respectively extended from a plurality of positions on the main wire set and spaced from each other. Each of the sub-wire sets includes a main branch set and a plurality of sub-branch sets. The sub-branch sets are extended in a direction away from the main wire set. All or some of the sub-branch sets are respectively extended from different positions on the main branch set.

In certain embodiments, the first wire includes a plurality of first sub-wires. The second wire includes a plurality of second sub-wires. The first sub-wires are respectively twisted together with the second sub-wires to respectively form the sub-wire sets. Each of the first sub-wires and the second sub-wires has a first end and a second end that is opposite to the first end. The first ends of the first sub-wires are twisted together. The first ends of the second sub-wires are twisted together. The first ends of the first sub-wires and the first ends of the second sub-wires are tied together at a tying position. The sub-wire sets are spread out in a direction away from the tying position.

In certain embodiments, a distance between the first ends of every two of the first sub-wires is smaller than a distance between the second ends of every two of the first sub-wires.

In certain embodiments, the light string further includes a wire collector by which the first ends of the first sub-wires and the first ends of the second sub-wires are tied together.

In certain embodiments, the light string further includes a base and a housing. The base has a first accommodation space and a second accommodation space. One or more batteries included in the power supply source are accommodated in the first accommodation space. The batteries are connected to the lighting controller accommodated in the second accommodation space. The batteries are configured to supply power synchronously or asynchronously to the wires. The base and the batteries are together sealed inside the housing.

In certain embodiments, the housing has a hook through which the housing is allowed to be hung on an external object.

In certain embodiments, the sub-wire sets are respectively extended from a plurality of positions on the main wire set toward ground. The positions are spaced from each other by a preset distance in a horizontal direction. The sub-wire sets are spaced from each other by the preset distance in the horizontal direction.

In certain embodiments, the sub-wire sets are disposed adjacent to each other. Each of the first sub-wires and the second sub-wires has a first end and a second end that is opposite to the first end. The first ends of the first sub-wires and the first ends of the second sub-wires are tied together in a tying position. The second ends of the first sub-wires and the second sub-wires are extended from the tying position toward ground. Some of the plurality of light-emitting diode chips are electrically bonded to the same one of the sub-wire sets and spaced from each other in a vertical direction.

In certain embodiments, the wires are wound around a wire-shaped object that is an insulator.

In certain embodiments, each of the light-emitting diode chips includes a single chip or multiple chips.

In certain embodiments, each of the light-emitting diode chips is disposed above the wire set, and the first wire and the second wire are respectively bonded to two opposite sides of each of the light-emitting diode chips.

In certain embodiments, each of the light-emitting diode chips is disposed between the first wire and the second wire, and the first wire and the second wire are respectively bonded to two opposite sides of each of the light-emitting diode chips.

As described above, the present disclosure provides the light strings fabricated in various shapes. The wires are twisted together in each of the light strings such that strengths of the wires are stronger and look neater. The wires may be extended in various special ways and the light-emitting diode chips are bonded onto the wires. The light-emitting diode chips may be covered with various covering elements and housed in various bulb shells, and emit light in multiple different lighting modes. Therefore, the light strings of the present disclosure can exhibit various lighting effects.

BRIEF DESCRIPTION OF THE DRAWINGS

The present disclosure will become more fully understood from the following detailed description and accompanying drawings in which.

DETAILED DESCRIPTION OF THE EXEMPLARY EMBODIMENTS

Figure 1:
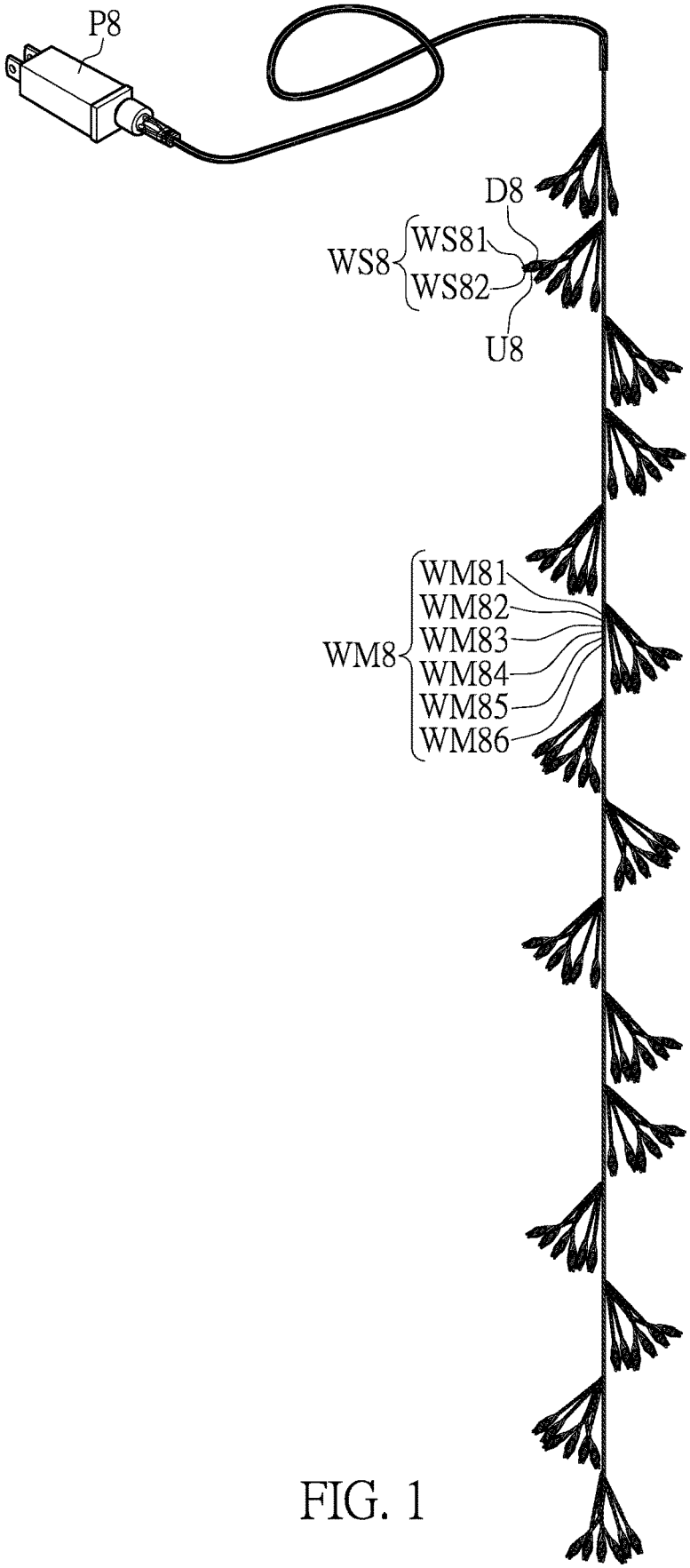
FIG. 1 is a schematic diagram of the light string that has twisted wires and looks like a grape according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

The light string may include a wire set, a plurality of light-emitting diode chips, a plurality of covering elements and a lighting controller, as various light strings exemplified in the following embodiments.

Reference is made to FIG. 1, which is a schematic diagram of the light string that has twisted wires and looks like a grape according to a first embodiment of the present disclosure.

In the embodiment, the light string looks like a grape. The light string includes a plurality of light-emitting diode chips D8 and a wire set. The wire set includes a main wire set WM8 and a plurality of sub-wire sets WS8.

In the wire set, a plurality of wires such as a first wire and a second wire are twisted together. The first wire includes a first main wire segment WM81 and a plurality of first sub-wire segments WS81. The second wire includes a second main wire segment WM82 and a plurality of second sub-wire segments WS82.

If necessary, the plurality of wires may further include one or more third wires such as four third wires WM83, WM84, WM85, WM86 in the embodiment. The third wires WM83, WM84, WM85, WM86 are twisted together with the first main wire segment WM81 of the first wire and the second main wire segment WM82 of the second wire to form the main wire set WM8.

Each of the first sub-wire segments WS81 and the second sub-wire segments WS82 includes a plurality of non-bonding segments and one or more bonding segments. The non-bonding segments of the first sub-wire segments WS81 and the second sub-wire segments WS82 are respectively twisted together to respectively form the sub-wire sets WS8. In other words, the non-bonding segments of one of the first sub-wire segments WS81 and one of the second sub-wire segments WS82 are twisted together to form one of the sub-wire sets WS8.

The sub-wire sets WS8 are classified into a plurality of groups. The plurality of groups are spaced from each other and extended outward in a direction respectively away from a plurality of position on the main wire set WM8. In the embodiment, the number of the groups is fifteen, but the present disclosure is not limited to thereto.

The sub-wire sets WS8 in the same group are extended from a same position on the main wire set WM8. The sub-wire sets WS8 in the different groups are respectively extended from a plurality of positions on the main wire set WM8. The sub-wire sets WS8 in the same group are extended from the same position on the main wire set WM8.

For example, in the embodiment, the number of the sub-wire sets WS8 in each of the groups is six. In practice, the number of the sub-wire sets WS8 in each of the groups may be fifteen. The present disclosure is not limited to the number of the sub-wire sets WS8 in each of the groups.

Each of the light-emitting diode chips D8 may include a single chip or multiple chips. The light-emitting diode chips D8 are respectively bonded to the bonding segments of the sub-wire sets WS8 and spaced from each other on the sub-wire sets WS8.

In detail, a positive terminal of each of the light-emitting diode chips D8 is electrically bonded to one of the first sub-wire segments WS81 of the first wire, and a negative terminal of each of the light-emitting diode chips D8 is electrically bonded to one of the second sub-wire segments WS82 of the second wire.

The light string may further include a plurality of covering elements U8. The light-emitting diode chips D8 may be covered respectively by a plurality of covering elements U8. Each of the covering elements U8 is made of a transparent material or a translucent material that is transparent to the light emitted by one of the light-emitting diode chips D8. The covering elements U8 may have milky white color or other colors. If necessary, the covering elements U8 may be atomized, or made of a transparent material, a non-transparent material or a translucent material, but the present disclosure is not limited thereto.

The light-emitting diode chips D8 may receive power sequentially through the sub-wire sets WS8, the main wire set WM8 and a plug P8 from an external power supply source.

Figure 2:
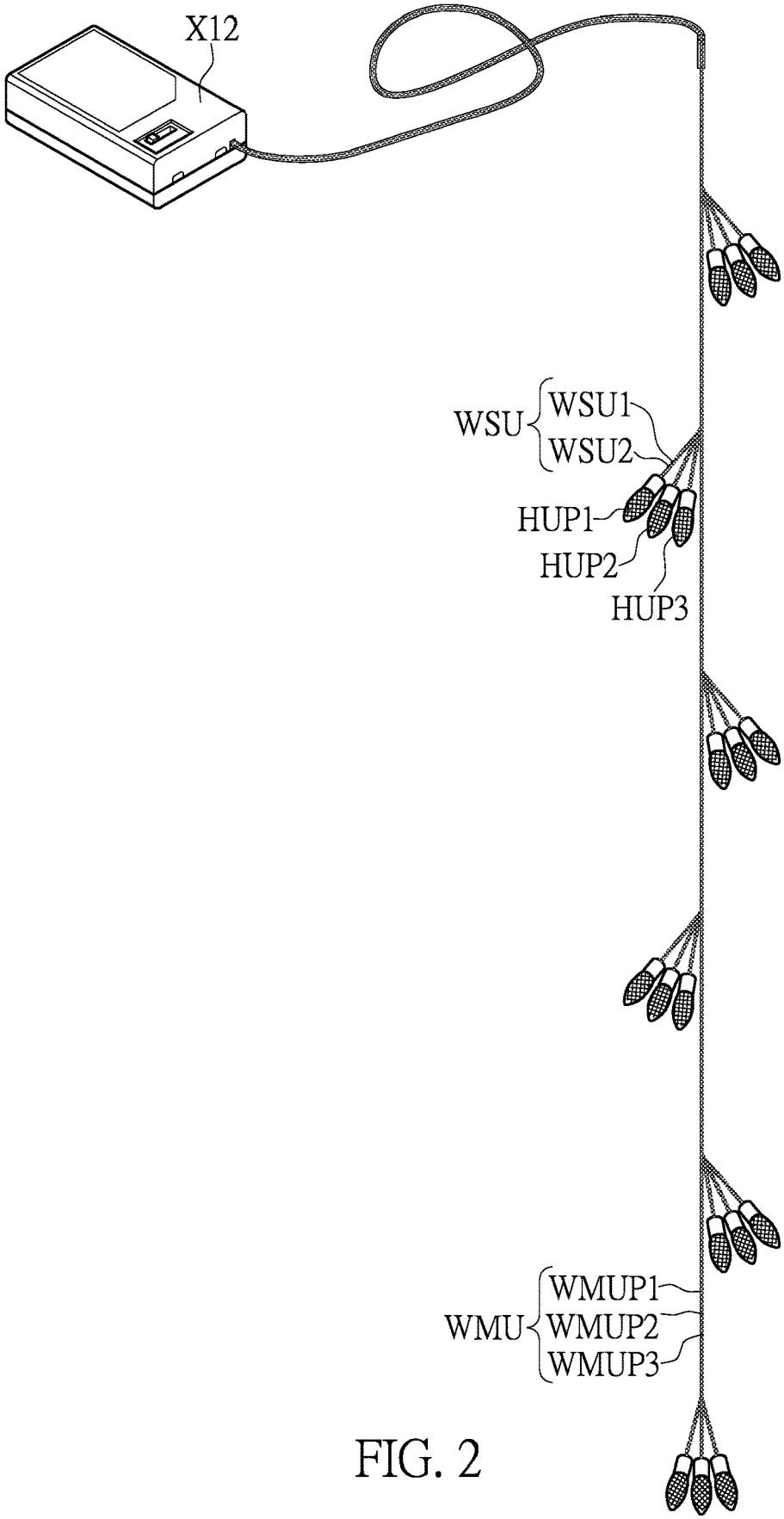
FIG. 2 is a schematic diagram of the light string that has twisted wires and looks like a grape according to a second embodiment of the present disclosure.

Reference is made to FIG. 2, which is a schematic diagram of the light string that has twisted wires and looks like a grape according to a second embodiment of the present disclosure.

The light string at least includes a first wire and a second wire. If necessary, the light string may further one of more wires such as a third wire WMUP3 in the embodiment. The first wire includes a first main wire segment WMUP1 and a plurality of first sub-wire segments WSU1. The second wire includes a second main wire segment WMUP2 and a plurality of second sub-wire segments WSU2.

The wire set includes a main wire set WMU and a plurality of sub-wire sets WSU. The third wire WMUP3 is twisted with the first main wire segment WMUP1 of the first wire and the second main wire segment WMUP2 of the second wire to form the main wire set WMU. A lighting controller is accommodated in a control box X12. The lighting controller of the control box X12 may be electrically connected to the first main wire segment WMUP1, the second main wire segment WMUP2 and the third wire WMUP3 of the main wire set WMU.

Each of the first sub-wire segments WSU1 of the first wire and the second sub-wire segments WSU2 of the second wire includes a plurality of non-bonding segment and one or more bonding segments. The non-bonding segments of the first sub-wire segments WSU1 and the second sub-wire segments WSU2 are respectively twisted together to respectively form the sub-wire sets WSU.

The sub-wire sets WSU are classified into a plurality of groups. In the embodiment, the number of the groups is six, and the number of the sub-wire sets WSU in each of the groups is three, but the present disclosure is not limited thereto. The groups are spaced from each other and extended outward in a direction respectively away from a plurality of position on the main wire set WMU. The sub-wire sets WSU in the same group are extended from the same position on the main wire set WMU.

The light string further includes a plurality of light-emitting diode chips. If necessary, the light string may further include a plurality of covering elements and a plurality of bulb shells HUP1, HUP2, HUP3. The light-emitting diode chips are respectively covered by the covering elements. The covering elements and the light-emitting diode chips are together respectively housed inside the bulb shells HUP1, HUP2, HUP3.

The number of the bulb shells HUP1 in each of the groups is equal to the number of the light-emitting diode chips. In the embodiment, the bulb shells HUP1, HUP2, HUP3 may have a same color or different colors such as yellow, green, red, blue and purple, and the number of the bulb shells HUP1 is three, but the present disclosure is not limited thereto.

Figure 3:
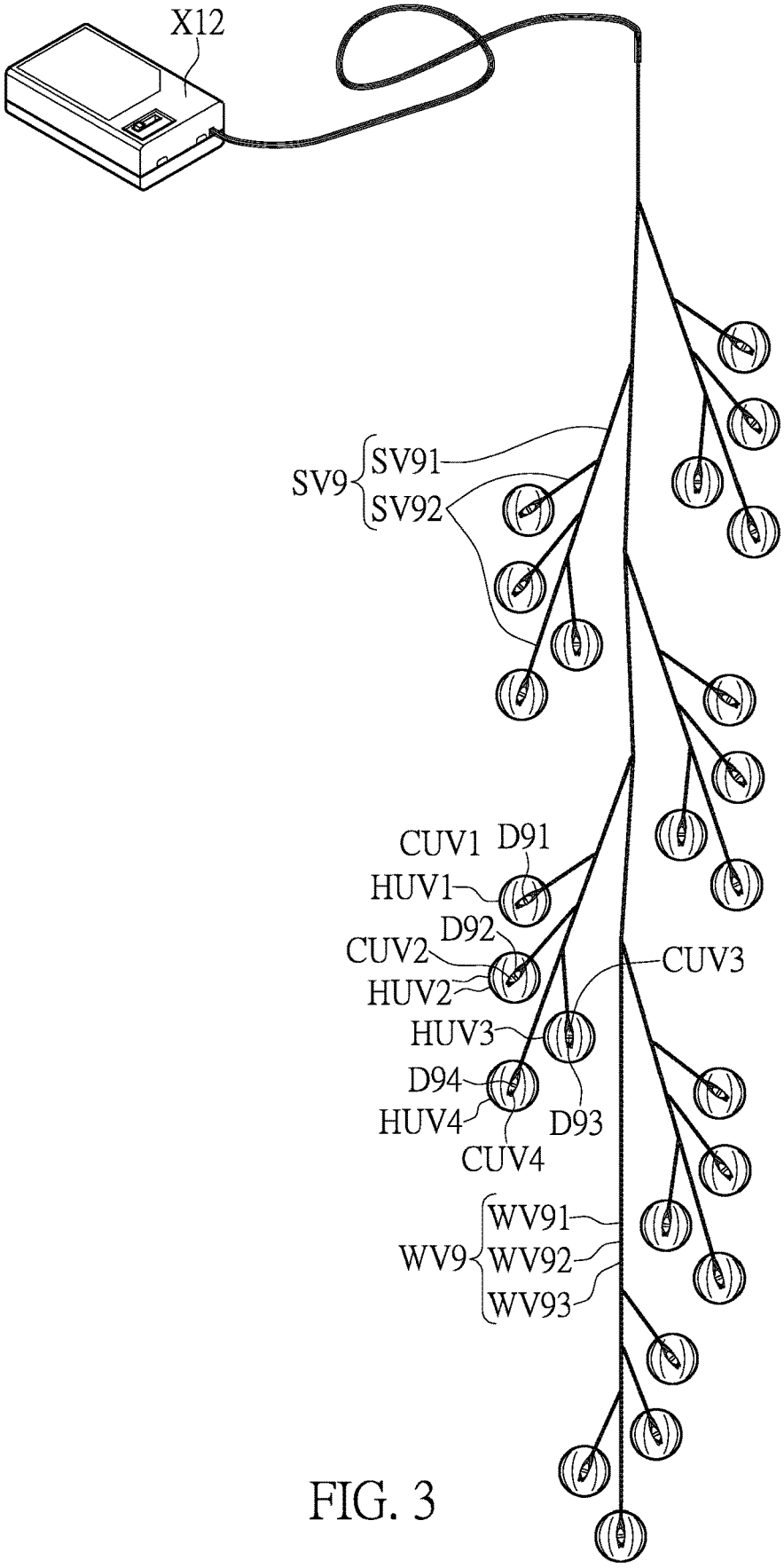
FIG. 3 is a schematic diagram of the light string that has twisted wires and looks like a grape according to a third embodiment of the present disclosure.

Reference is made to FIG. 3, which is a schematic diagram of the light string that has twisted wires and looks like a grape according to a third embodiment of the present disclosure.

The light string may include a first wire, a second wire and a third wire WV93. The third wire WV93 is twisted with a first main wire segment WV91 of the first wire and a second main wire segment WV92 of the second wire to form a main wire set WV9.

First sub-wire segments of the first wire and second sub-wire segments of the second wire are respectively twisted together to respectively form a plurality of sub-wire sets SV9. The sub-wires SV9 are respectively extended from a plurality of positions on the main wire set WV9 and spaced from each other. Some of the sub-wires SV9 are extended at a first side of the main wire set WV9, but others of the sub-wires SV9 are at a second side of the main wire set WV9 that is opposite to the first side of the main wire set WV9.

In detail, each of the sub-wire sets SV9 includes a main branch set SV91 and a plurality of sub-branch sets SV92. The main branch sets SV91 are extended from the plurality of positions on the main wire set WV9. In each of the sub-wire sets SV9, all or some of the sub-branch sets SV92 are respectively extended from different positions on the main branch set SV91.

In the embodiment, the number of sub-wire sets SV9 is six, in each of the sub-wire sets SV9, the number of the sub-branch sets SV92 is four and the number of light-emitting diode chips D91 to D94 is four, but the present disclosure is not limited thereto.

The light-emitting diode chips D91 to D94 are respectively bonded onto bonding segments of the sub-branch sets SV92. In practice, more light-emitting diode chips may be electrically bonded on each of the sub-branch sets SV92.

The light-emitting diode chips D91 to D94 may be covered by covering elements CVU1 to CVU4, and respectively housed together with the covering elements CVU1 to CVU4 inside the bulb shells HUV1 to HUV4. Each of the bulb shells HUV1 to HUV4 may have a spherical shape and red color, but the present disclosure is not limited thereto.

The light string may further include the lighting controller and the power supply source that are accommodated in the control box X12. The lighting controller of the control box X12 may be electrically connected to the main wire set WV9, the sub-wire set SV9, and the power supply source. The lighting controller may receive and transmit power from the power supply source to the light-emitting diode chips D91 to D94 through the main wire set WV9 and the sub-wire set SV9. The lighting controller may output a control signal respectively to the light-emitting diode chips D91 to D94 through the main wire set WV9 and the sub-wire set SV9 to control the light-emitting diode chips D91 to D94 to emit light.

Figure 4:
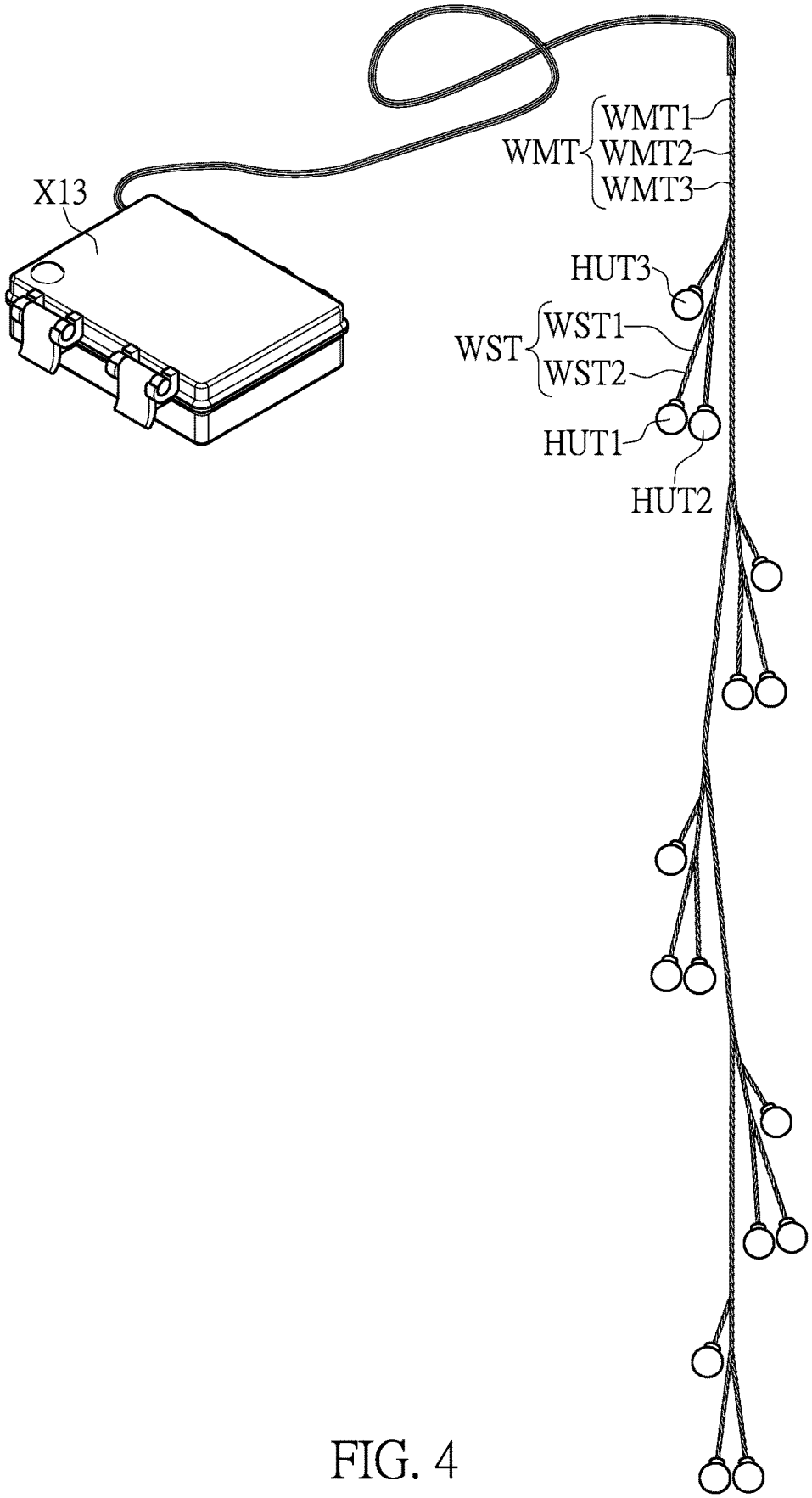
FIG. 4 is a schematic diagram of the light string that has twisted wires and looks like a grape according to a fourth embodiment of the present disclosure.

Reference is made to FIG. 4, which is a schematic diagram of the light string that has twisted wires and looks like a grape according to a fourth embodiment of the present disclosure. The same descriptions of the third and fourth embodiments are not repeated herein, but differences of them are described in the following.

The number of sub-branch sets WST is three. Three light-emitting diode chips are respectively bonded to the three sub-branch sets WST and housed inside three bulb shells HUT1, HUT2, HUT3. A size of each of the bulb shells HUT1 to HUT3 shown in FIG. 4 is smaller than a size of each of the bulb shells HUV1 to HUV4 shown in FIG. 3. Each of the bulb shells HUT1, HUT2, HUT3 may have milky white color. However, the present disclosure is not limited to sizes, color, shape and the number of bulb shells, and lengths and the number of sub-branch sets.

Figure 5:
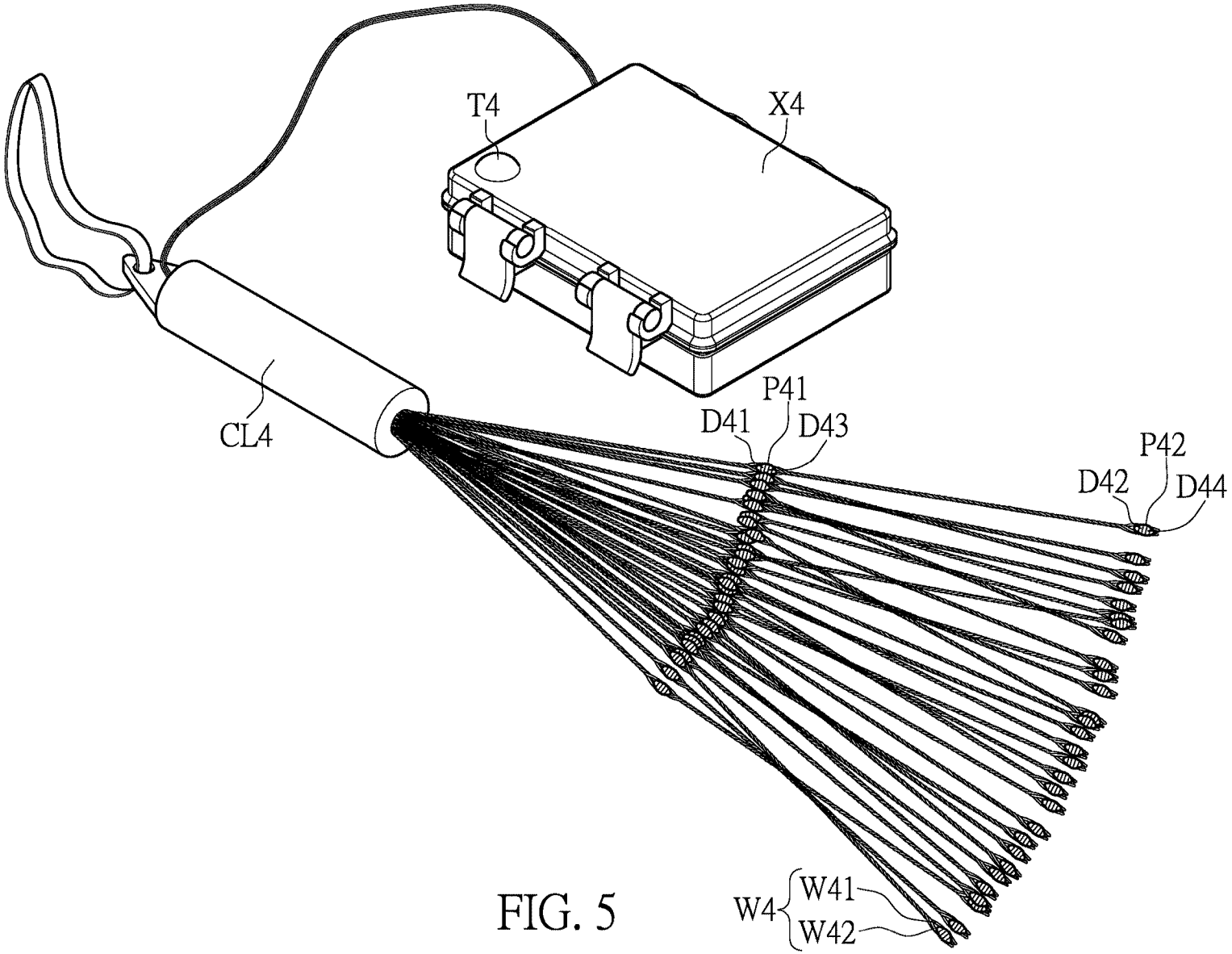
FIG. 5 is a schematic diagram of the light string having twisted wires that are extended outward from a wire collector according to a fifth embodiment of the present disclosure.

Reference is made to FIG. 5, which is a schematic diagram of the light string having twisted wires that are extended outward from a wire collector according to a fifth embodiment of the present disclosure.

The light string at least includes a first wire and a second wire. The first wire includes a plurality of first sub-wires W41. The second wire includes a plurality of second sub-wires W42. One of the first sub-wires W41 and one of the second sub-wires W42 are classified in a same group, and are twisted together to form a sub-wire set W4. Each of the sub-wire sets W4 is extended outward in a first direction away from a wire collector CL4 such that distances between the sub-wire sets W4 increase along the first direction.

Each of the first sub-wires W41 and the second sub-wires W42 has a first end and a second end that is opposite to the first end. The first ends of the first sub-wires W41 are twisted together. The first ends of the second sub-wires W42 are twisted together. The first ends of the first sub-wires W41 and the first ends of the second sub-wires W42 are tied together at a tying position. The sub-wire sets are spread out in a direction away from the tying position. A distance between the first ends of every two of the first sub-wires W41 is smaller than a distance between the second ends of every two of the first sub-wires W41.

Second ends of the first sub-wires W41 are collected together by the wire collector CL4 along a second direction opposite to the first direction. In addition, second ends of the second sub-wires W42 are collected together by the wire collector CL4 along the second direction opposite to the first direction.

One or more light-emitting diode chips may be electrically bonded to each of the sub-wire sets W4, wherein each of the light-emitting diode chips includes a single chip or multiple chips. For example, in the embodiment, two light-emitting diode chips are electrically bonded to each of the sub-wire sets W4, wherein one of the light-emitting diode chips includes double chips that are represented by the emitting diode chips D41, D43, and another of the light-emitting diode chips includes double chips that are represented by the emitting diode chips D42, D44.

One of the emitting diode chips D41, one of the emitting diode chips D43, one of the emitting diode chips D42, one of the emitting diode chips D44 are electrically bonded to the same one of the sub-wire sets W4. A positive terminal and a negative terminal of each of the light-emitting diode chips D41 to D44 are respectively bonded to one of the first sub-wires W41 and one of the second sub-wires W42.

The emitting diode chips D41, D42 that are bonded to the same sub-wire set W4 may be spaced from each other by a first distance. The first distances of the sub-wire sets W4 may be equal to each other. Similarly, the emitting diode chips D43, D44 that are bonded to the same sub-wire set W4 may be spaced from each other by a second distance. The second distances of the sub-wire sets W4 may be equal to each other.

Each of the emitting diode chips D41, D43 is bonded onto a middle wire segment among a plurality of wire segments of one of the sub-wire sets W4. Each of the emitting diode chips D42, D44 is bonded onto a position close to the first end of one of the sub-wire sets W4.

The emitting diode chips D41 that are respectively bonded onto the middle wire segments of the sub-wire sets W4 may be aligned with each other. The emitting diode chips D42 that are respectively bonded onto the positions close to the first ends of the sub-wire sets W4 may be aligned with each other.

Each of the light-emitting diode chips D41, D43 is covered by a covering element P41. Each of the light-emitting diode chips D42, D44 is covered by a covering element P42. The covering elements P41 are made of transparent materials or translucent materials that are transparent to light emitted by the light-emitting diode chips D41, D43. The covering elements P42 are made of transparent materials or translucent materials that are transparent to light emitted by the light-emitting diode chips D42, 44.

Some or all of the covering elements P42 may have the same color as the covering elements P41, or have different colors from that of the covering elements P41. In addition, some or all of the covering elements P42 respectively at the ends of the sub-wire sets W4 may have the same color or different colors to each other. Some or all of the covering elements P41 on the middle segments of the sub-wire sets W4 may have the same color or different colors to each other.

When a button T4 is pressed, a lighting controller in a control box X4 is triggered to control the light-emitting diode chips D41 to D44 to emit light.

Figure 6:
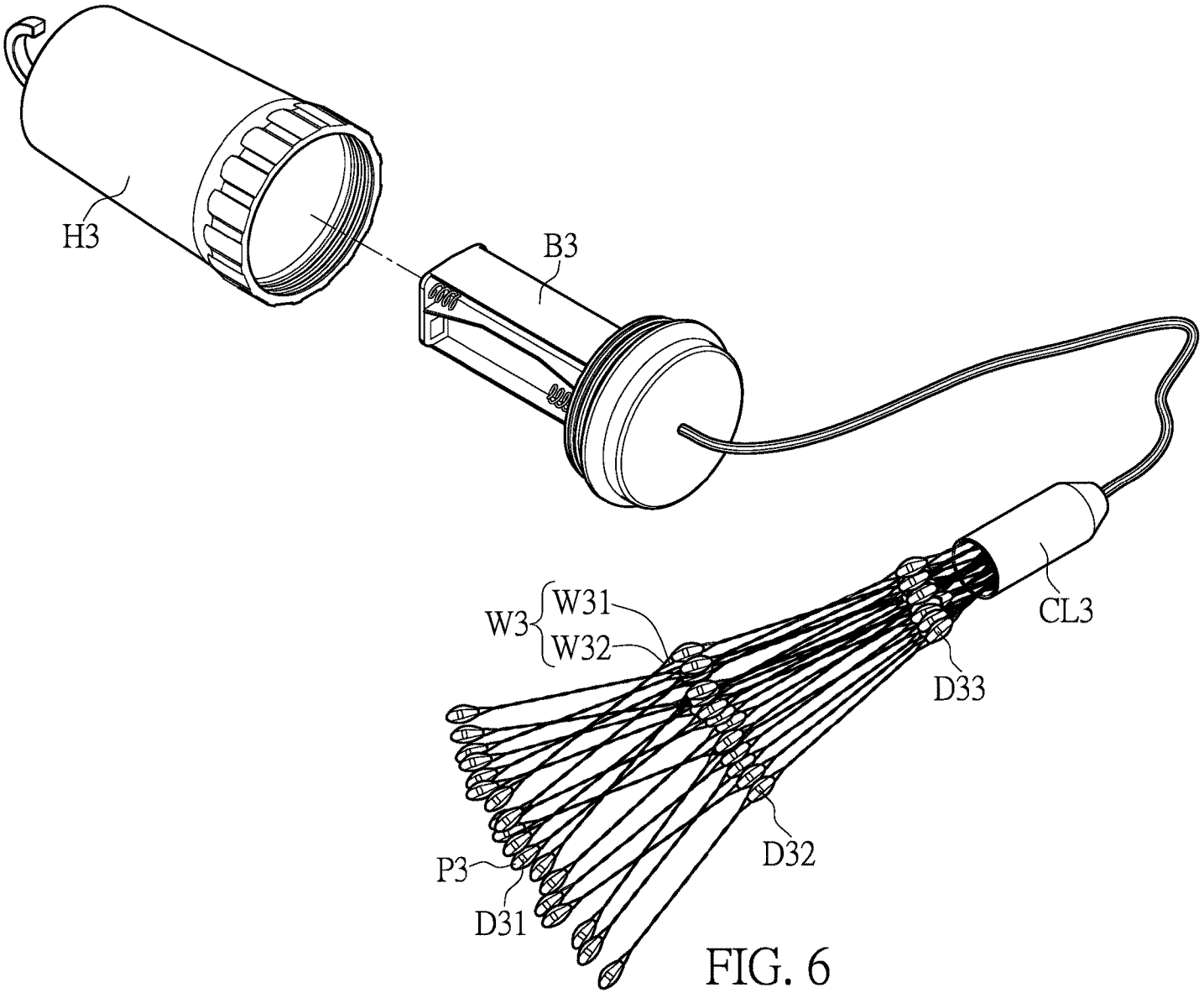
FIG. 6 is an exploded view of the light string having twisted wires that are extended outward from a wire collector according to a sixth embodiment of the present disclosure.
Figure 7:
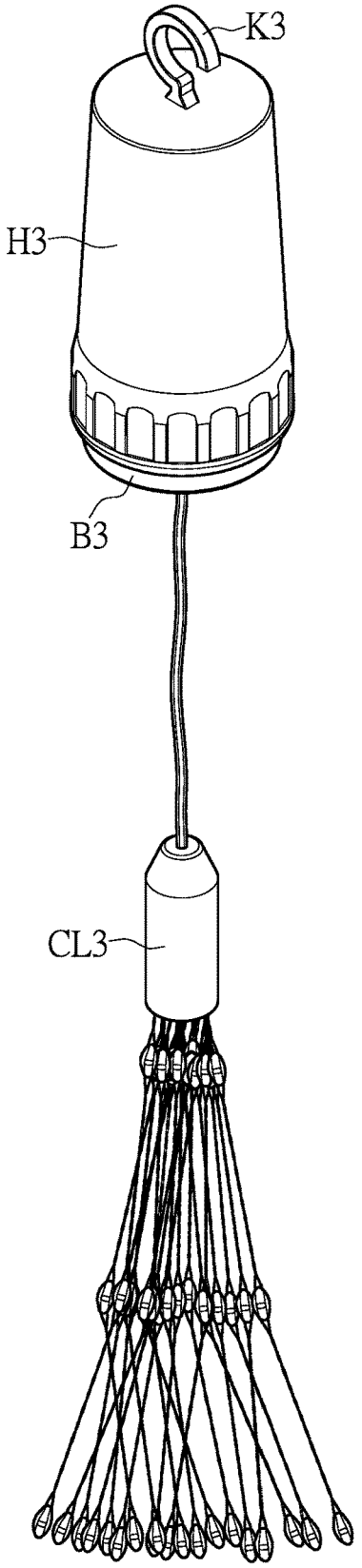
FIG. 7 is a schematic diagram of the light string that includes a base housed inside a housing according to the sixth embodiment of the present disclosure.

Reference is made to FIGS. 6 and 7, wherein an exploded view of the light string having twisted wires that are extended outward from a wire collector according to a sixth embodiment of the present disclosure, and an exploded view of the light string having twisted wires that are extended outward from a wire collector according to a sixth embodiment of the present disclosure The light string includes a plurality of first wires W31 and a plurality of second wires W32 that are classified into a plurality of groups. One of the first wires W31 and one of the second wires W32 are classified into the same group and are twisted together to form a sub-wire set W3. Each of the sub-wire sets W3 is extended outward in a first direction such that distances between the sub-wire sets increase along the first direction.

One or more of the plurality of light-emitting diode chips are bonded to each of the sub-wire sets. For example, the light string includes a plurality of light-emitting diode chips D31, D32, D33. One of the light-emitting diode chips D31, one of the light-emitting diode chips D32 and one of the light-emitting diode chips D33 are bonded to the same sub-wire set W3 and spaced from each other. Each of the light-emitting diode chips D31 to D33 may include a single chip or multiple chips.

A positive terminal and a negative terminal of each of the light-emitting diode chips D31, D32, D33 are respectively bonded to one of the first sub-wires W41 and one of the second sub-wires W42. A distance between the light-emitting diode chips D31 and D32 may be the same as or different from a distance between the light-emitting diode chips D32 and D33.

Each of the light-emitting diode chips D31, D32, D33 may be covered by a covering element P3. The covering elements D31, D32, D33 are made of transparent materials or translucent materials that are transparent to light emitted by the light-emitting diode chips D31, D32, D33.

The light string may further include a base B3 and a housing H3. The housing H3 may have a hook K3 through which the light string may be hung on an external object such as a door or a wall for decoration. The base B3 is housed inside the housing H3 such that one or more batteries installed on the base B3 are sealed inside the housing H3.

The base B3 has a first accommodation space and a second accommodation space. Power supply sources such as one or more batteries of the light string may be accommodated in the first accommodation space of the base B3, and connected to the lighting controller accommodated in the second accommodation space. The power supply sources may supply power synchronously or asynchronously to the sub-wire sets W3. A lighting controller of the light string may transmit controlling signals to the light-emitting diode chips D31 to D33 through the sub-wire sets W3 for controlling the light-emitting diode chips D31 to D33 to emit light.

Figure 8:
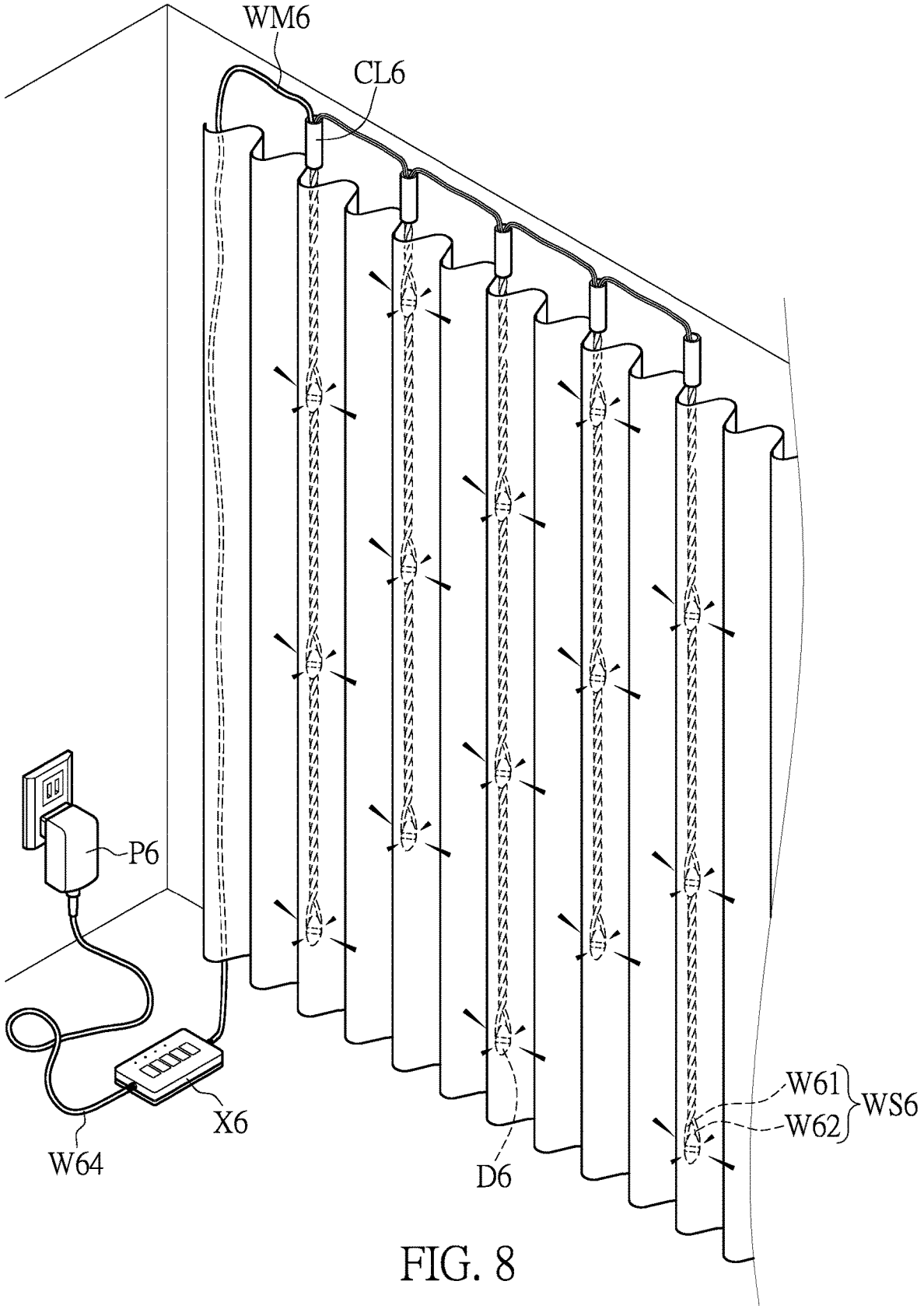
FIG. 8 is a schematic diagram of the light string having twisted wires that is hung together with a curtain according to a seventh embodiment of the present disclosure.

Reference is made to FIG. 8, which is a schematic diagram of the light string having twisted wires that is hung together with a curtain according to a seventh embodiment of the present disclosure.

In the embodiment, the light string may be hung on the wall or a curtain for decoration. The light string includes a plurality of wires. Each of the wires includes a main wire segments WM6, a plurality of first sub-wire segments W61 and a plurality of second sub-wire segments W62.

The main wire segments WM6 of the wires are twisted together to form a main wire set WM6. The first sub-wire segments W61 and The second sub-wire segments W62 are respectively twisted together to respectively form a plurality of sub-wire sets WS6. One of the first sub-wire segments W61 and one of the second sub-wire segments W62 are twisted together to form one of the sub-wire sets WS6.

The light string further includes a plurality of light-emitting diode chips D6. One of more of the that plurality of light-emitting diode chips D6 such as the four light-emitting diode chips D6 in the embodiment are bonded onto each of the sub-wire sets WS6, but the present disclosure is not limited thereto. Each of the light-emitting diode chips D6 may include a single chip or multiple chips.

The sub-wire sets WS6 are extended respectively from a plurality of positions on the main wire set WM6 in a direction away from the main wire set WM6 toward ground. The positions are spaced from each other by a preset distance in a horizontal direction, and the sub-wire sets WS6 are spaced from each other by the preset distance in the horizontal direction.

A positive terminal and a negative terminal of each of the light-emitting diode chips D6 are respectively connected to bonding segments of the first sub-wire segments W61 and the second sub-wire segments W62 in the same sub-wire set WS6. The sub-wire sets WS6 are connected to a lighting controller accommodated in a control box X6. The lighting controller is electrically connected to an external power supply source through a plug P6. The lighting controller may transmit power to the light-emitting diode chips D6 sequentially through the main wire set WM6 and the sub-wire sets WS6 from the external power supply source.

Figure 9:
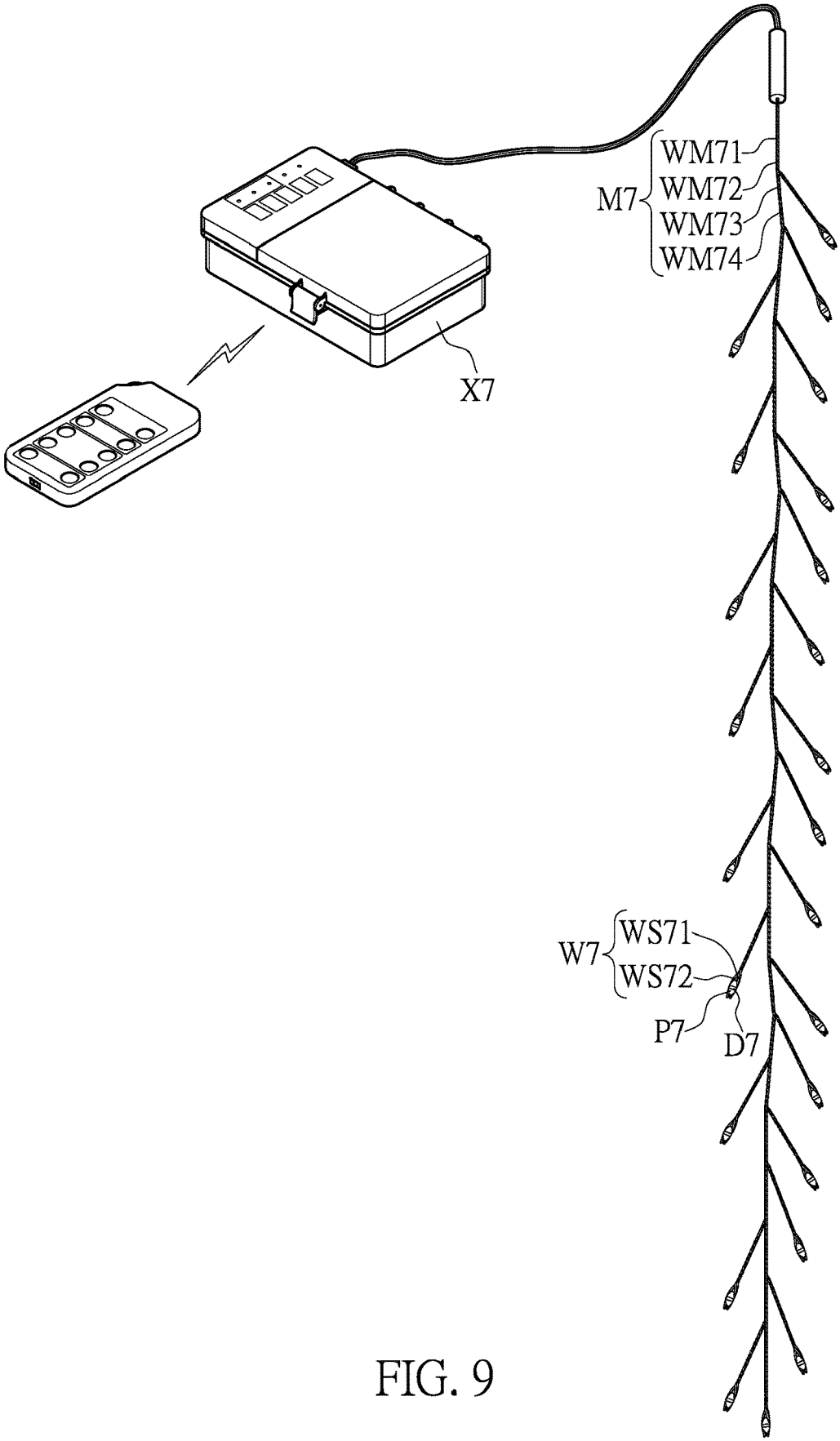
FIG. 9 is a schematic diagram of the light string that has twisted wires and looks like a firecracker according to an eighth embodiment of the present disclosure.

Reference is made to FIG. 9 is a schematic diagram of the light string that has twisted wires and looks like a firecracker according to an eighth embodiment of the present disclosure.

In the embodiment, the light string looks like the firecracker.

The light string includes a plurality of wires such as a first wire, a second wire, a third wire WM73 and a fourth wire WM74. The third wire WM73 and the fourth wire WM74 are entirely twisted together and twisted with a main wire segment WM71 of the first wire and a main wire segment WM72 of the second wire to from a main wire set M7.

A plurality of first sub-wire segments WS71 of the first wire are respectively twisted with a plurality of second sub-wire segments WS72 of the second wire to respectively form a plurality of sub-wire sets W7.

The sub-wire sets W7 are extended respectively from a plurality of bonding segments on the main wire set M7 in a direction away from the main wire set M7 toward ground. The sub-wire sets W7 are spaced from each other by a distance. Some of the sub-wire sets W7 are at a first side of the main wire set M7, but others of the sub-wire sets W7 are at a second side of the main wire set M7 that is opposite to the first side of the main wire set M7.

The light-emitting diode chips D7 are respectively bonded onto the sub-wire sets W7, and respectively covered by covering elements P7. Each of the light-emitting diode chips D7 may include a single chip or multiple chips.

Figure 10:
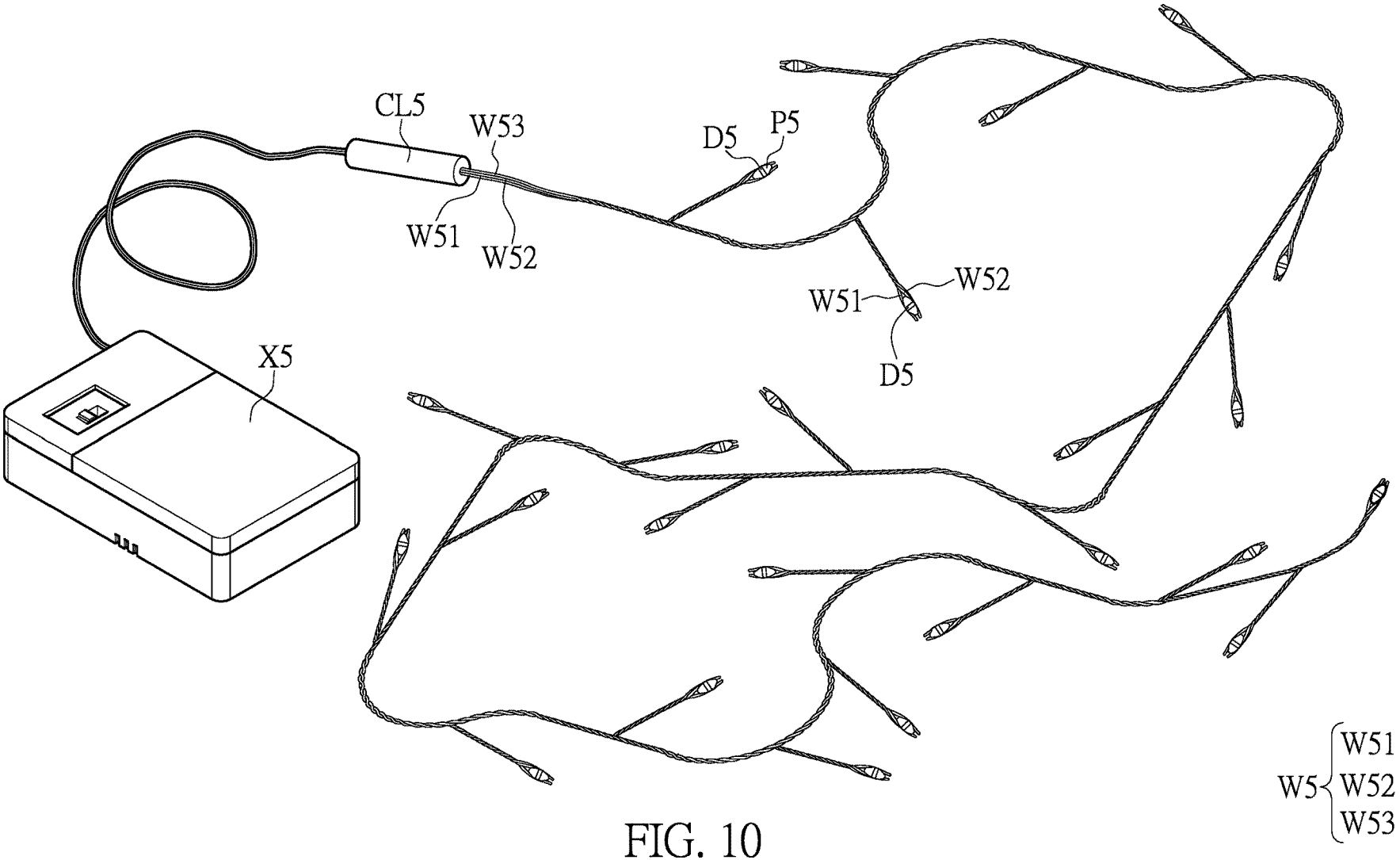
FIG. 10 is a schematic diagram of the light string that has twisted wires and looks like tree branches according to a ninth embodiment of the present disclosure.
Figure 11:
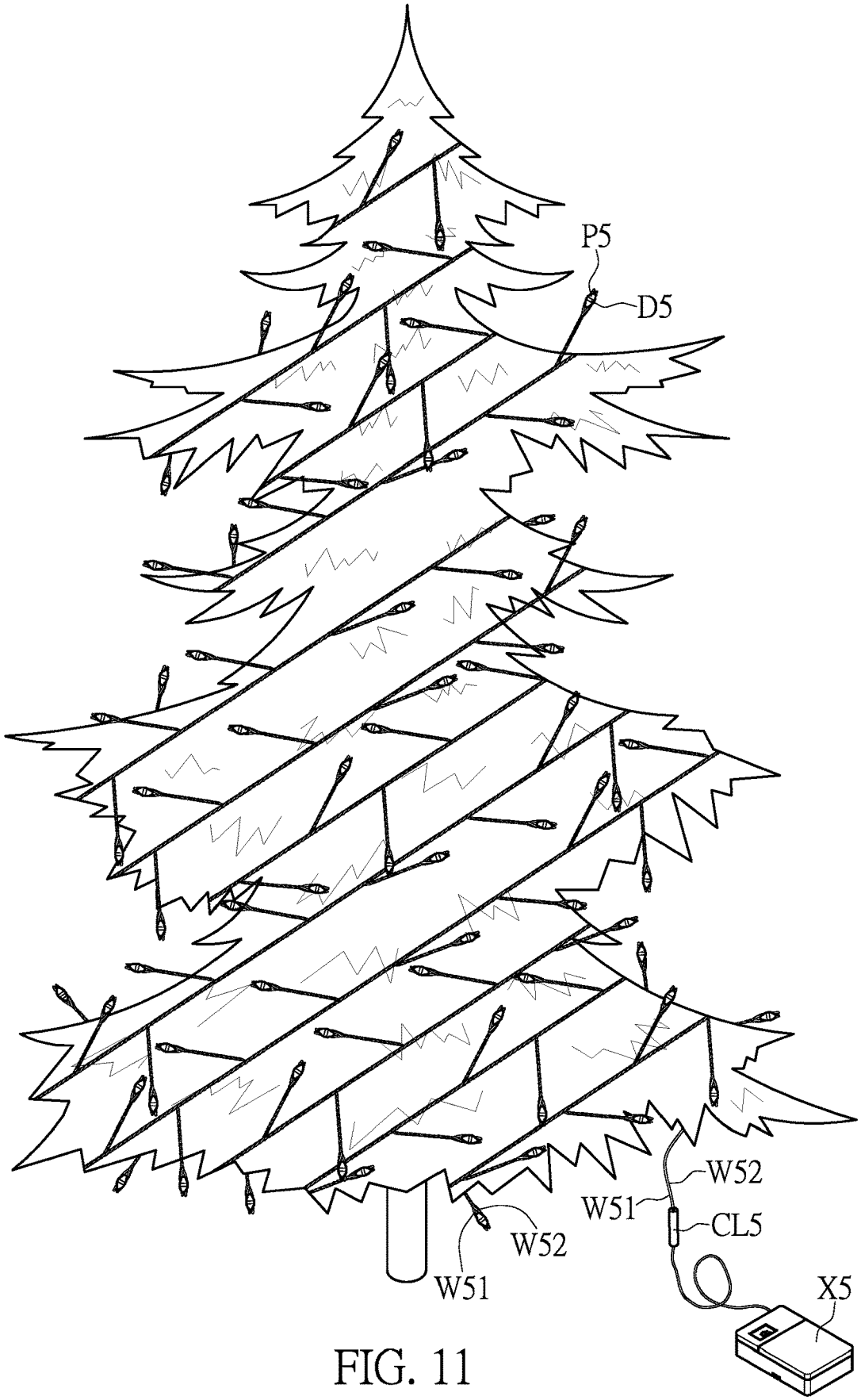
FIG. 11 is a schematic diagram of the light string that looks like tree branches and is wound around a Christmas tree according to the ninth embodiment of the present disclosure.

Reference is made to FIGS. 10 and 11, wherein FIG. 10 is a schematic diagram of the light string that has twisted wires and looks like tree branches according to a ninth embodiment of the present disclosure, and FIG. 11 is a schematic diagram of the light string that looks like tree branches and is wound around a Christmas tree according to the ninth embodiment of the present disclosure. The same or similar descriptions of the embodiments are not repeated herein.

In the embodiment, the light string looks like tree branches. The light string may be wound around the Christmas tree, but the present disclosure is not limited thereto.

The light string includes a plurality of wires such as a first wire W51, a second wire W52, a third wire W53. The third wire W53 is twisted with a main wire segment of the first wire W51 and the second wire W52 to from a main wire set. A plurality of first sub-wire segments of the first wire W51 are respectively twisted with a plurality of second sub-wire segments of the second wire W52 to respectively form a plurality of sub-wire sets.

The sub-wire sets W5 are extended respectively from a plurality of bonding segments on the main wire set in a direction away from the main wire set. The sub-wire sets are spaced from each other by a distance. A plurality of light-emitting diode chips D5 are respectively bonded onto the sub-wire sets, and respectively covered by covering elements P5. Each of the light-emitting diode chips D5 may include a single chip or multiple chips.

Figure 12:
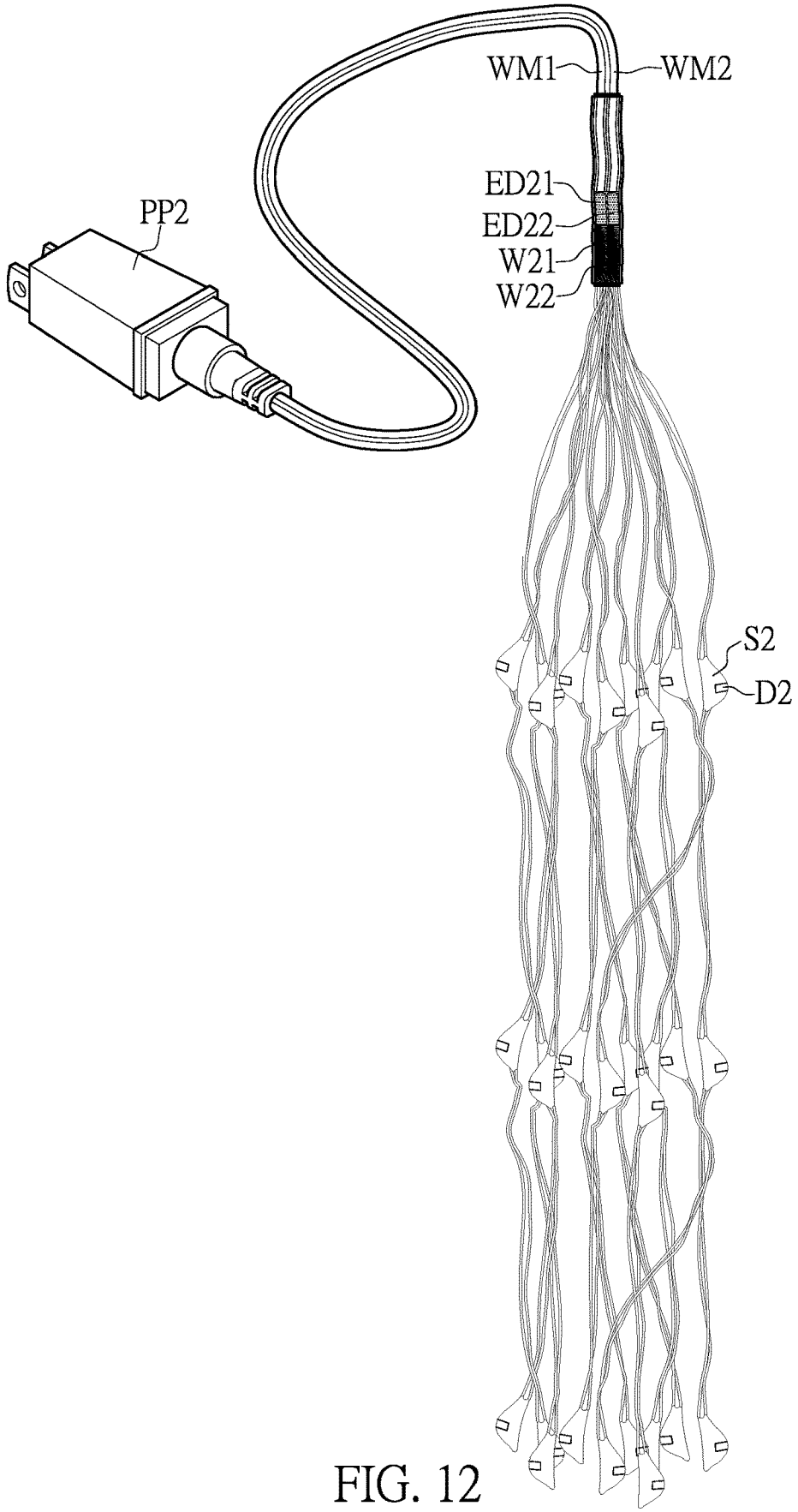
FIG. 12 is a schematic diagram of the light string that has twisted wires and looks like a waterfall according to a tenth embodiment of the present disclosure.

Reference is made to FIG. 12, which is a schematic diagram of the light string that has twisted wires and looks like a waterfall according to a tenth embodiment of the present disclosure.

In the embodiment, the light strings are hung on a wall or the like so that they look like a waterfall.

The light string includes a plurality of wires such as a plurality of first wires W21 and a plurality of second wires W22. The first wires W21 are respectively twisted with the second wires W22 to respectively form a plurality of sub-wire sets.

The light string further includes a plurality of light-emitting diode chips D2 that are electrically bonded onto each of the sub-wire sets. Each of the light-emitting diode chips D2 may include a single chip or multiple chips. The light-emitting diode chips D2 that are bonded onto the same sub-wire set are spaced from each other by a distance in a vertical direction. A positive terminal and a negative terminal of each of the light-emitting diode chips are respectively connected to one of the first wires W21 and one of the second wires W22. Each of the light-emitting diode chips D2 may be covered by a covering element S2.

Figure 13:
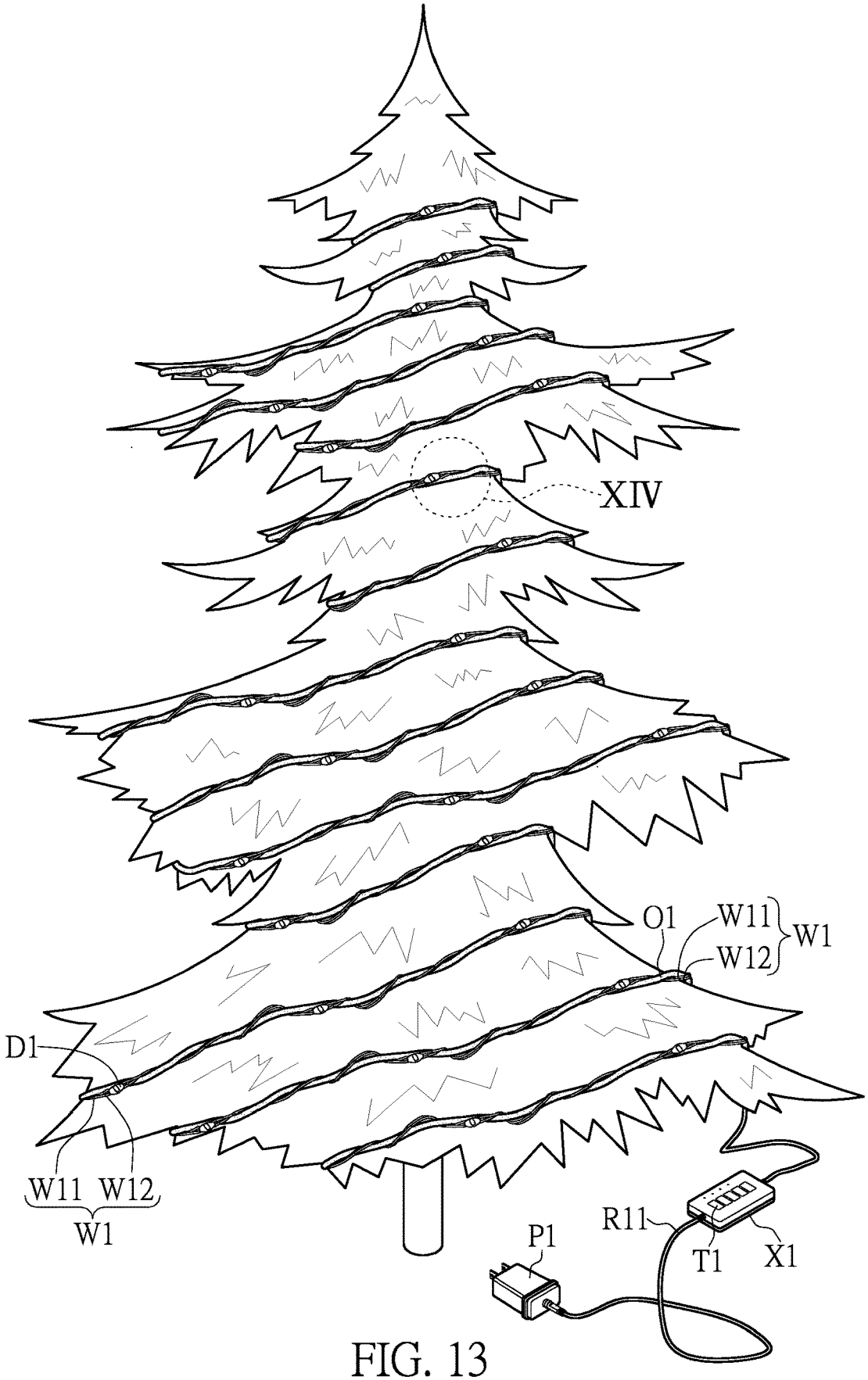
FIG. 13 is a schematic diagram of the light string that has twisted wires and looks like a shallot and is wound around the Christmas tree according to an eleventh embodiment of the present disclosure.
Figure 14:
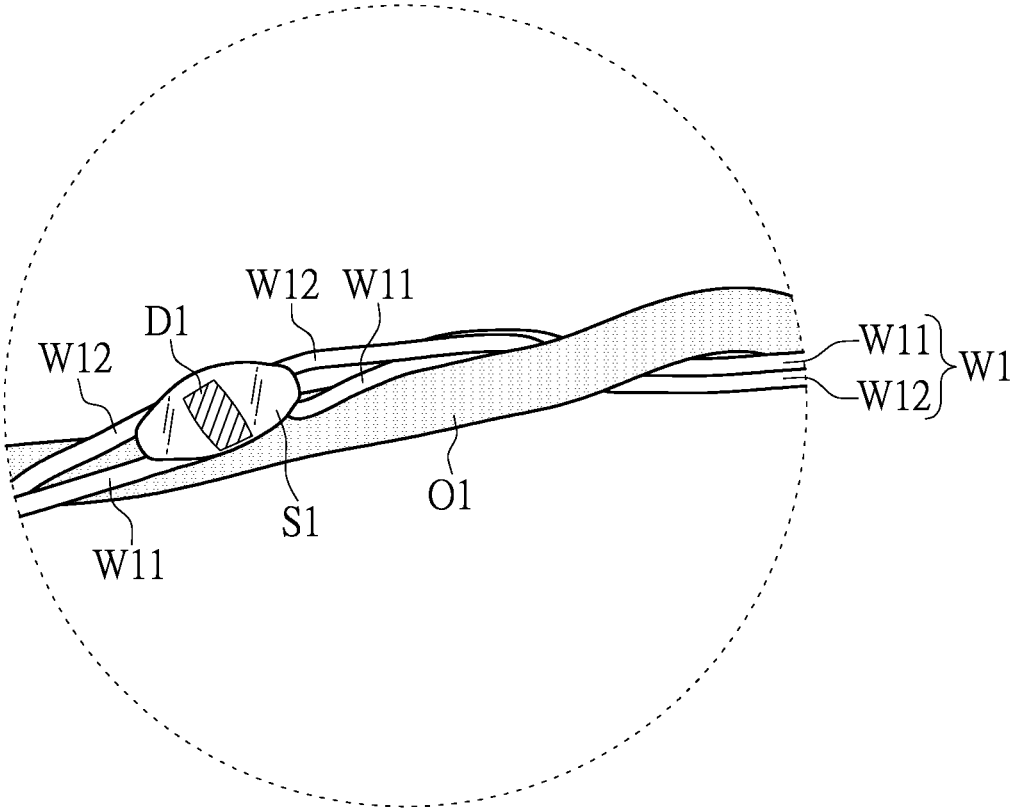
FIG. 14 is a schematic diagram of an area encompassed by a circle IB in the light string that looks like the shallot according to the eleventh embodiment of the present disclosure.

Reference is made to FIGS. 13 and 14, wherein FIG. 13 is a schematic diagram of the light string that has twisted wires and looks like a shallot and is wound around the Christmas tree according to an eleventh embodiment of the present disclosure, and FIG. 14 is a schematic diagram of an area encompassed by a circle IB in the light string that looks like the shallot according to the eleventh embodiment of the present disclosure.

The light string includes a wire set W1 and a plurality of light-emitting diode chips D1. The wire set W1 includes a first wire W11 and a second wire W12 that may be twisted together to form the wire set W1. A positive terminal of each of the light-emitting diode chips D1 is electrically bonded to the first wire W1. A negative terminal of each of the light-emitting diode chips D1 is electrically bonded to the second wire W2. The light-emitting diode chips D1 are spaced from each other by a distance on the wire set W1.

For example, two opposite sides of each of the light-emitting diode chips D1 are respectively bonded to the first wire W1 and the second wire W2. Each of the light-emitting diode chips D1 is disposed above the wire set W1 or is disposed between the first wire W1 and the second wire W2.

The light string may further include a plurality of covering elements S1 by which the light-emitting diode chips D1 are respectively covered. Each of the light-emitting diode chips D1 may include a single chip or multiple chips.

The first wire W11 and the second wire W12 may be wound around a wire-shaped object O1 that is an insulator and may look like the shallot. The first wire W11, the second wire W12 and the wire-shaped object O1 may be wound around or separately from the Christmas tree. The wire-shaped object may have a silver color or other colors for decoration.

The light string may further include a lighting controller accommodated into a control box X1. The lighting controller in the control box X1 is electrically connected to a plug P1 through a power transmission wire R11. When the plug P1 is inserted into the socket, the lighting controller obtains power from a power supply source through the plug P1 and transmits the power to the light-emitting diode chips D1 through the wire set W1.

After the lighting controller obtains the power, the lighting controller may control some or all of the light-emitting diode chips D1 to synchronously emit light that may have the same color or different colors during a time interval. The lighting controller may adjust the amount of power supplied to each of the light-emitting diode chips D1 to adjust brightness of the light by emitted by each of the light-emitting diode chips D1.

In summary, the present disclosure provides the light strings fabricated in various shapes. The wires are twisted together in each of the light strings such that strengths of the wires are stronger and look neater. The wires may be extended in various special ways and the light-emitting diode chips are bonded onto the wires. The light-emitting diode chips may be covered with various covering elements and housed in various bulb shells, and emit light in multiple different lighting modes. Therefore, the light strings of the present disclosure can exhibit various lighting effects.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A light string having a plurality of twisted wires, comprising:

a wire set including a main wire set and a plurality of sub-wire sets, wherein a plurality of wires includes a first wire and a second wire, the first wire includes a first main wire segment and a plurality of first sub-wire segments, the second wire includes a second main wire segment and a plurality of second sub-wire segments, the first main wire segment and the second main wire segment are twisted together to form the main wire set, each of the first sub-wire segments and the second sub-wire segments includes a plurality of non-bonding segments and one or more bonding segments, the non-bonding segments of the first sub-wire segments and the second sub-wire segments are respectively twisted together to respectively form the sub-wire sets, and the sub-wire sets are spaced from each other and extended outward in a direction away from the main wire set;

a plurality of light-emitting diode chips that are respectively bonded to the bonding segments of the sub-wire sets and spaced from each other on the sub-wire sets; and a lighting controller electrically connected to the wires and a power supply source, and configured to receive and transmit power from the power supply source to the light-emitting diode chips and output a control signal respectively to the light-emitting diode chips through the wires to control the light-emitting diode chips to emit light.

2. The light string having the twisted wires according to claim 1, wherein a positive terminal of each of the light-emitting diode chips is electrically bonded to one of the first sub-wire segments, and a negative terminal of each of the light-emitting diode chips is electrically bonded to one of the second sub-wire segments.

3. The light string having the twisted wires according to claim 1, further comprising:

a plurality of covering elements by which the plurality of light-emitting diode chips are respectively covered, wherein each of the covering elements is made of a transparent material or a translucent material that is transparent to the light emitted by one of the light-emitting diode chips.

4. The light string having the twisted wires according to claim 3, wherein the covering elements are atomized, or made of a transparent material, a non-transparent material or a translucent material.

5. The light string having the twisted wires according to claim 3, further comprising:

a plurality of bulb shells inside which the covering elements are respectively housed.

6. The light string having the twisted wires according to claim 1, wherein the sub-wire sets are classified into a plurality of groups that are spaced from each other, the sub-wire sets in different ones of the groups are respectively extended from a plurality of positions on the main wire set, and the sub-wire sets in the same one of the groups are extended from the same position on the main wire set.

7. The light string having the twisted wires according to claim 1, wherein the plurality of wires further includes one or more third wires that are twisted with the first main wire segment of the first wire and the second main wire segment of the second wire to form the main wire set.

8. The light string having the twisted wires according to claim 1, wherein the sub-wires are respectively extended from a plurality of positions on the main wire set and spaced from each other, each of the sub-wire sets includes a main branch set and a plurality of sub-branch sets, the sub-branch sets are extended in a direction away from the main wire set, and all or some of the sub-branch sets are respectively extended from different positions on the main branch set.

9. The light string having the twisted wires according to claim 1, wherein the first wire includes a plurality of first sub-wires, the second wire includes a plurality of second sub-wires, the first sub-wires are respectively twisted together with the second sub-wires to respectively form the sub-wire sets, each of the first sub-wires and the second sub-wires has a first end and a second end that is opposite to the first end, the first ends of the first sub-wires are twisted together, the first ends of the second sub-wires are twisted together, the first ends of the first sub-wires and the first ends of the second sub-wires are tied together at a tying position.

10. The light string having the twisted wires according to claim 9, wherein the sub-wire sets are spread out in a direction away from the tying position, and a distance between the first ends of every two of the first sub-wires is smaller than a distance between the second ends of every two of the first sub-wires.

11. The light string having the twisted wires according to claim 9, further comprising:

a wire collector by which the first ends of the first sub-wires and the first ends of the second sub-wires are tied together.

12. The light string having the twisted wires according to claim 1, further comprising:

a base having a first accommodation space and a second accommodation space, wherein one or more batteries included in the power supply source are accommodated in the first accommodation space, connected to the lighting controller accommodated in the second accommodation space, and configured to supply power synchronously or asynchronously to the wires; and a housing inside which the base and the batteries are together sealed.

13. The light string having the twisted wires according to claim 12, wherein the housing has a hook through which the housing is allowed to be hung on an external object.

14. The light string having the twisted wires according to claim 1, wherein the sub-wire sets are respectively extended from a plurality of positions on the main wire set toward ground, the positions are spaced from each other by a preset distance in a horizontal direction, and the sub-wire sets are spaced from each other by the preset distance in the horizontal direction.

15. The light string having the twisted wires according to claim 1, wherein the sub-wire sets are disposed adjacent to each other, each of the first sub-wires and the second sub-wires has a first end and a second end that is opposite to the first end, the first ends of the first sub-wires and the first ends of the second sub-wires are tied together in a tying position, the second ends of the first sub-wires and the second sub-wires are extended from the tying position toward ground, some of the plurality of light-emitting diode chips are electrically bonded to the same one of the sub-wire sets and spaced from each other in a vertical direction.

16. The light string having the twisted wires according to claim 1, wherein the wires are wound around a wire-shaped object that is an insulator.

17. The light string having the twisted wires according to claim 1, wherein each of the light-emitting diode chips includes a single chip or multiple chips.

18. The light string having the twisted wires according to claim 1, wherein each of the light-emitting diode chips is disposed above the wire set, and the first wire and the second wire are respectively bonded to two opposite sides of each of the light-emitting diode chips.

19. The light string having the twisted wires according to claim 1, wherein each of the light-emitting diode chips is disposed between the first wire and the second wire, and the first wire and the second wire are respectively bonded to two opposite sides of each of the light-emitting diode chips.

* * * * *